United States Patent [19]

Strongin et al.

[11] 4,033,070

[45] July 5, 1977

[54] TOY FOAM GLIDER

[76] Inventors: Ned Strongin, 936 Willow Bend Lane, Baldwin, N.Y. 11510; A. Edward Fogarty; Bonnie Rose Fogarty, both of 3513 School Ave., Sarasota, Fla. 33579

[22] Filed: July 2, 1975

[21] Appl. No.: 592,609

[52] U.S. Cl. ..... 46/79

[51] Int. Cl.[2] ..... A63H 27/00

[58] Field of Search ..... 46/79

[56] References Cited

UNITED STATES PATENTS

| | | | |
|---|---|---|---|
| 2,364,498 | 12/1944 | Walker | 46/79 |
| 3,063,191 | 11/1962 | Main | 46/79 |
| 3,187,460 | 6/1965 | Robertson | 46/79 |
| 3,246,425 | 4/1966 | Miller | 46/79 |
| 3,898,763 | 8/1975 | Rizzo | 46/79 |
| 3,909,976 | 10/1975 | Kirk | 46/79 |

*Primary Examiner*—John F. Pitrelli
*Assistant Examiner*—Robert F. Cutting
*Attorney, Agent, or Firm*—Edward F. Levy

[57] ABSTRACT

A toy glider includes a fuselage, a wing and a rudder made of flexible resilient foam. The wing passes through a slot in the fuselage and a notched portion on the leading edge, and a notched portion on the trailing edge of the wing interlock with the fuselage.

9 Claims, 3 Drawing Figures

TOY FOAM GLIDER

The present invention relates in general to toy airplanes and more particularly to a toy glider made of a flexible plastic foam material.

Conventional toy gliders have, in the past, been made of light wood such as balsa wood, or other lightweight rigid material, and when used by children, the fragility of these toy gliders has been readily apparent. The relatively great fragility of materials such as balsa wood, especially in the thin sections utilized in wing and tail portions of conventional toy gliders, leads to objectionable breaking and splintering, thus resulting in limited play value. In addition, conventional toy gliders, made of balsa wood, usually have a fuselage portion in the form of a thin stick in order to conserve weight. This results in a generally unrealistic appearance. In recent attempts to overcome the drawbacks of balsa wood gliders, toy gliders have been manufactured using a plastic formed of expanded beads such as styrofoam. Although light in weight and relatively easily moldable, this material is relatively rigid and easily broken, when handled by children. When broken, the fracture zone of this type of plastic crumbles into small beads which are relatively hard to clean, thus making this type of glider objectionable for indoor play.

The present invention overcomes the deficiencies of the prior art by providing a toy foam glider which is made of a flexible plastic foam. The toy foam glider, according to the present invention, includes a fuselage portion which has the general outline of an aircraft fuselage and which has a horizontal slot to accommodate a wing portion and a vertical slot to accommodate a rudder portion. The wing and rudder portions are manufactured of a relatively thin sheet of a closed-cell flexible foam and the fuselage is manufactured of a relatively low density open-cell foam. The wing is slightly wider than the length of the horizontal slot and the leading and trailing edges of the wing are notched to fit the width of the fuselage to interlock therewith and thereby retain the wing relative to the fuselage. The flexibility of both the fuselage and the wing enables the wing to be inserted into the horizontal slot and to lock onto the fuselage when the notched portions engage the fuselage. The forward portion of the fuselage includes a solid plastic cylinder which serves as a balance weight thus improving the aerodynamic properties of the toy foam glider. The flexibility of the fuselage and the wing and rudder enables the toy foam glider to absorb the energy of impact without damage to either the toy foam glider or to windows, walls or furniture, thus facilitating safe indoor play.

It is an object of the present invention to provide a toy foam glider which is unbreakable in normal use.

Another object of the present invention is to provide a toy foam glider which may be used indoors without damage to furnishings as a result of collisions.

Another object of the present invention is to provide a toy foam glider made of a flexible plastic foam.

Another object of the present invention is to provide a toy foam glider of the character described having a balance weight imparting good aerodynamic characteristics.

Still another object of the present invention is to provide a toy foam glider which may be manufactured using relatively low cost, high volume tooling, resulting in a relatively low unit cost and permitting wide distribution.

Additional objects and advantages of the invention will become apparent during the course of the following specification, when taken in connection with the accompanying drawings in which.

Figure 1:
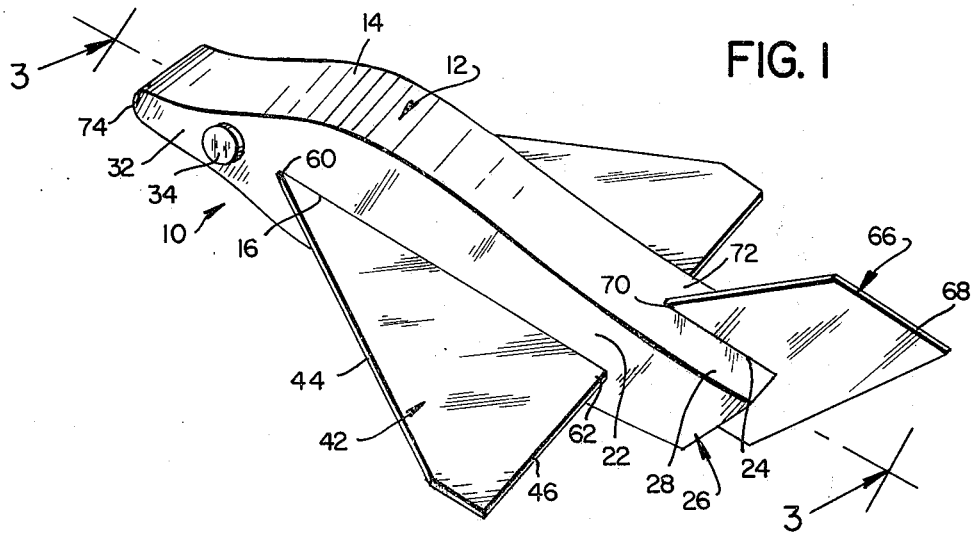
FIG. 1 is an overall perspective view of a toy foam glider in accordance with the present invention.

With reference to the drawing, there is shown in FIG. 1 a toy foam glider 10, made in accordance with the present invention. The toy foam glider 10 includes a fuselage 12 which has a contoured peripheral surface 14 generally resembling the contour of an aircraft fuselage. A straight-walled wing slot 16, which is generally perpendicular to the sides 18 and 20 of the fuselage 12, is located in a central portion 22 of the fuselage 12. A straight-walled rudder slot 24 is located at the rear 26 of the fuselage 12 and is perpendicular to the top fuselage surface 28. The fuselage 12 also includes a circular hole 30 in the forward portion 32 of the fuselage 12 for the purpose of retaining a balance weight 34 which serves to improve the flight characteristics of the toy foam glider 10. The balance weight 34 has a cylindrical central portion 36 and a pair of end flanges 38 and 40. The diameter of the central portion 36 corresponds to the diameter of the circular hole 30 and during the installation of the balance weight 34, the material of the fuselage 12 is stretched over the end flange 40 and then returns to shape, thus retaining the balance weight 34.

Figure 2:
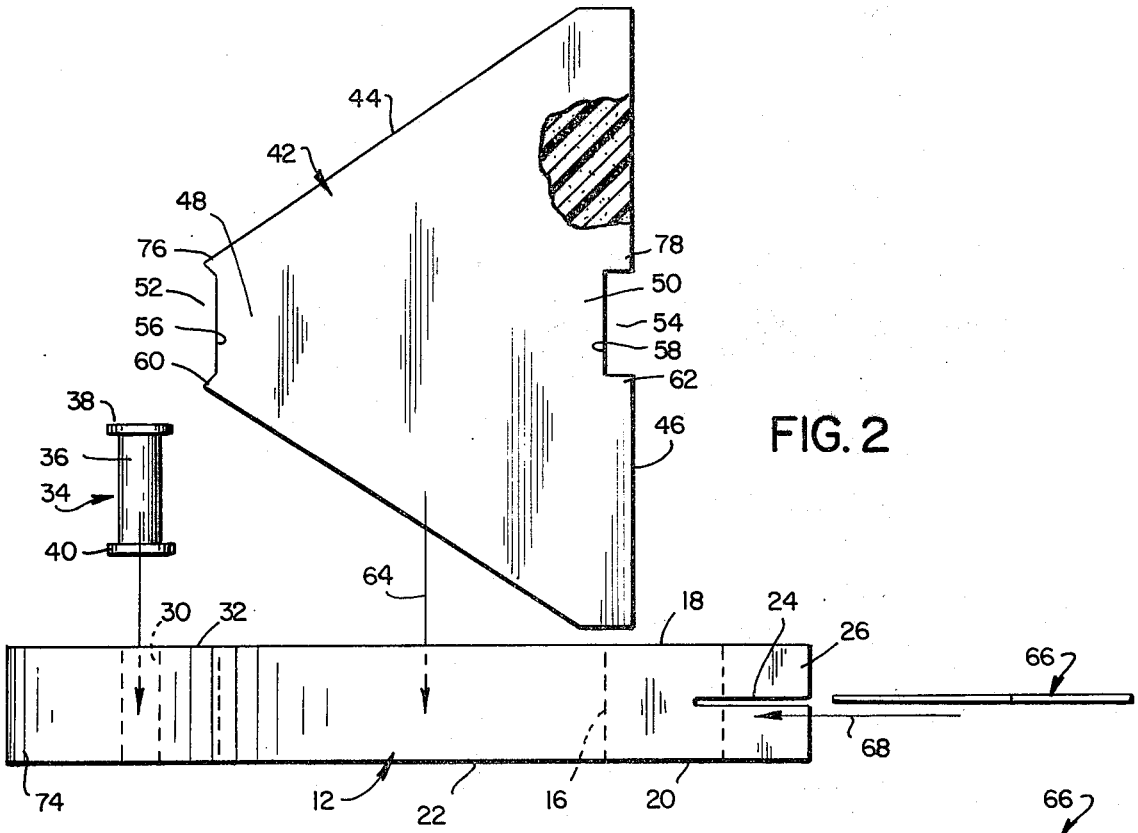
FIG. 2 is an exploded top plan view of the component parts of the toy foam glider of FIG. 1.

The wing 42 of the toy foam glider 10 has a tapered leading edge 44 and a straight trailing edge 46 resulting in a delta wing configuration. The central portion 48 of the leading edge 44 and the central portion 50 of the trailing edge 46 have respective notched portions 52 and 54, as shown in FIG. 2. The distance between edge 56 of notch 52 and edge 58 of notch 54 corresponds to the length of the wing slot 16 and the width of the notch 52 and notch 54 corresponds to the width of the fuselage 12. During installation of the wing 42, the material of the fuselage 12 is stretched over the corners 60 and 62 and of the wing 42 when the wing 42 is inserted into the wing slot 16 in the direction of the arrow 64 in FIG. 2. The material of the fuselage 12 and the wing 42 return to shape after the installation of the wing 42, thus retaining the wing 42 in place.

Figure 3:
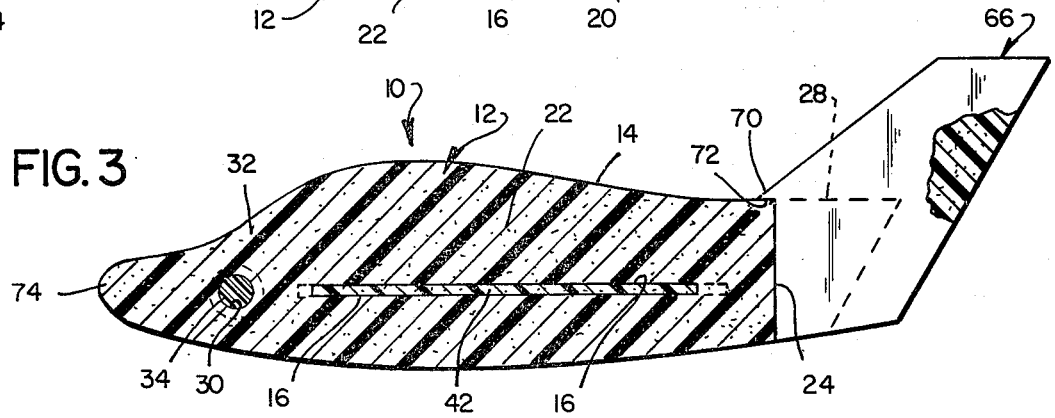
FIG. 3 is a longitudinal sectional view taken along the line 3—3 of FIG. 1.

The toy foam glider 10 also includes a rudder 66 which is inserted in the rudder slot 24 in the direction of the arrow 68 in FIG. 2. The rudder 66 has a projecting tab 70 which rests on the surface 72 of the fuselage 12, as shown in FIG. 3, thus locating the rudder 66 in the vertical direction.

In a preferred embodiment of the invention, the fuselage 12 of the toy foam glider 10 is made of a relatively low density open cell foam, such as polyurethane foam and the wing 42 and the rudder 68 are made of a closed cell elastomeric foam having a somewhat greater density then the foam used for the fuselage. The relatively low density of the foam used for the fuselage 12 makes possible the use of a thickness of foam which permits a more realistic representation of the thickness of an aircraft fuselage than is possible using conventional toy glider materials such as balsa wood. The relatively low stiffness and the resiliency of the foam material permits the use of the toy foam glider 10 indoors without the danger of damage to walls or furniture, or to the toy foam glider 10 itself, due to impact during collision.

The tapered nose portion 74 of the fuselage 12 deforms easily and presents a relatively soft impact area which absorbs the energy of impact and then returns to its original shape. Similarly the wing 12 and the rudder 66 deform during impact and then return to their original shape leaving the toy foam glider 10 undamaged. The relatively high coefficient of friction between the foam material of the fuselage 12 and the wing 42 and rudder 66 portions combined with the corners 60, 62, 76 and 78 on the wing 42 and the projecting tab 70 on the rudder 66 reduces the possibility of the wing 42 or the rudder 66 becoming dislodged during use.

While a preferred embodiment of the invention has been shown and described herein, it is obvious that numerous additions, changes and omissions may be made in such embodiment without departing from the spirit and scope of the invention.

What is claimed is:

1. A toy foam glider including a fuselage made of a soft, bendable, flexible and resilient foam material, a wing member comprising a thin flat panel of flexible light-weight plastic material, said fuselage having a width appreciably greater than the thickness of said wing member, means for removably mounting said wing member on said fuselage, said mounting means comprising a longitudinal slot extending through the width of said fuselage and sized to receive and retain a central portion of said wing member therein, said wing member having an over-all width greater than the length of said slot, and said central portion having a width substantially equal to the length of said slot, and a balance weight mounted on said fuselage and located forwardly of said wing member, said balance weight comprising a central cylindrical portion and a pair of end flanges, said fuselage having a hole extending transversely therethrough and receiving the cylindrical central portion of said balance weight.

2. A toy foam glider according to claim 1 in which said wing member has at least one notch in the central portion thereof sized to receive the body of said fuselage when said wing member is inserted in said slot, with the body portion of the wing member bordering said notch embracing the sides of said fuselage.

3. A toy foam glider according to claim 2 in which said slot is of a length smaller than the width of the central portion of said wing member, requiring said wing member to be deformed when inserted into said slot, and with said wing member returning to shape when said notch receives said fuselage.

4. A toy foam glider according to claim 3 in which said wing has a leading edge and a trailing edge and in which said leading edge and said trailing edge each have a notch in the central portion thereof registering with said slot in said fuselage.

5. A toy foam glider according to claim 4 in which each of said notches have side edges embracing the side surfaces of the fuselage when said wing member is received in said slot, whereby to lock said wing member in mounted position.

6. A toy foam glider according to claim 1 in which said fuselage is made of a resilient flexible polyurethane foam.

7. A toy foam glider according to claim 1 in which said fuselage is made of a low density open cell foam.

8. A toy foam glider according to claim 1 which also includes a tail member comprising a flat panel of flexible light-weight plastic material, and a slot formed in the tail portion of said fuselage and sized to receive and retain said tail member.

9. A toy foam glider according to claim 8 in which said wing portion and tail portion are each made of a closed cell foam material.

* * * * *